United States Patent [19]

James

[11] Patent Number: 4,884,387

[45] Date of Patent: Dec. 5, 1989

[54] VERTICAL FORM-FILL-SEAL METHOD AND APPARATUS

[75] Inventor: Robert C. James, Sheboygan, Wis.

[73] Assignee: Hayssen Manufacturing Company, Sheboygan, Wis.

[21] Appl. No.: 210,872

[22] Filed: Jun. 24, 1988

[51] Int. Cl.[4] ..... B65B 9/20; B65B 41/12; B65B 41/16

[52] U.S. Cl. ..... 53/451; 53/551; 53/552; 53/389

[58] Field of Search ..... 226/170, 171, 172; 53/450, 451, 550, 551, 552, 389

[56] References Cited

U.S. PATENT DOCUMENTS

| | | | |
|---|---|---|---|
| 2,935,178 | 5/1960 | Lütcke | 226/172 |
| 3,227,344 | 1/1966 | Rutter | 226/172 X |
| 3,610,500 | 10/1971 | Brown | 226/172 |
| 4,288,965 | 9/1981 | James | 53/451 |
| 4,578,931 | 4/1986 | Gijsbertus | 53/551 |
| 4,620,409 | 11/1986 | McElvy | 53/551 |
| 4,655,291 | 4/1987 | Cox | 226/172 X |
| 4,660,356 | 4/1987 | Simionato | 53/551 |
| 4,727,707 | 3/1988 | Hadden | 53/552 X |

*Primary Examiner*—Horace M. Culver
*Attorney, Agent, or Firm*—Senniger, Powers, Leavitt and Roedel

[57] ABSTRACT

Method of and apparatus for forming, filling and sealing packages wherein a web of flexible packaging interval is formed into tubing around a mandrel and intermittently fed downwardly in package length increments by intermittently moving portions of continuously driven belts into engagement with the tubing for a predetermined interval.

14 Claims, 7 Drawing Sheets

VERTICAL FORM-FILL-SEAL METHOD AND APPARATUS

BRIEF SUMMARY OF THE INVENTION

This invention relates to methods of and apparatus for intermittently feeding measured lengths of tubing formed of flexible sheet material in a vertical form-fill-seal packaging operation.

The invention is especially directed to the intermittent downward feeding of package length increments of tubing formed of flexible sheet packaging around a mandrel in a vertical form-fill-seal packaging machine such as that shown in Robert C. James U.S. Pat. No. 4,288,965 of issued Sept. 15, 1981 to Hayssen Manufacturing Company of Sheboygan, Wis., to which this invention and application are also assigned, such machines having been extensively sold worldwide under the trademark ULTIMA of Hayssen Manufacturing Company. In the machine as shown in said James patent, a web of flexible packaging material, e.g., plastic film, is formed into tubing around a downwardly extending mandrel, the tubing being intermittently fed downwardly on the mandrel and off its lower end in package length increments for being sealed at package length intervals below the lower end of the mandrel, product to be packaged being delivered through the mandrel. The intermittent downfeed is by a pair of belts engaging the tubing at opposite sides of the mandrel, these belts being started, driven for an interval, and stopped during a feed cycle.

While the start-stop operation of the belts in the ULTIMA machine referred to has generally been quite satisfactory commercially, there are instances where the starting and stopping of the belts may be quite critical, particularly where higher rates of production are sought while holding the package length within acceptable commercial tolerances (e.g., plus or minus 1/32 inch), and especially where the packaging material is pre-printed with printed matter recurring at package length intervals and registration of the printed matter in relation to the sealing of the tubing is effected as by means of an electric eye to detect a suitable print location and transmit a signal to stop the belts. Where higher rates of production (higher number of packages per minute and/or higher rates of feed for the tubing) are sought, the greater is the potential for package length inaccuracies.

Reference may be made to U.S. Pat. Nos. 4,578,931 and 4,620,409, which address problems created by the utilization of belts to feed tubing down on a mandrel in vertical form-fill-seal operations, the first of these disclosing use of continuously driven vacuum belts with vacuum being drawn in the suction boxes for the belts for frictional engagement between the belts and the tubing for the feed of the tubing and vented to stop the feed, the second of these disclosing use of belts on parallelogram linkages with displacement of three sides of each linkage to move a reach of the belt into and out of engagement with the tubing, and with a clutch and brake system for starting and stopping the belts. The second referenced patent may not only have problems because of belt starting and stopping and attendant belt acceleration and deceleration but also because of the inertia of the said three sides of the linkage. While the first referenced patent may avoid any problem due to belt acceleration and deceleration, it is believed to involve relatively high initial cost (requiring a relatively high capacity vacuum pump), relatively high operating costs (the pump having relatively high power requirements) and relatively high maintenance cost.

Accordingly, among the several objects of this invention may be noted the provision of an improved method of and apparatus for intermittently feeding tubing downwardly on a mandrel in package length increments in forming packages by the vertical form-fill-seal technique for higher rates of production while holding the package length within required tolerances (e.g., ±1/32 inch); the provision of such a method and apparatus wherein the feed or advance is effected by continuously driven belts, with simplified, effective and reliable control of the belts for engagement thereof with and disengagement thereof from the material or tubing for accurate feed of the material or tubing; and the provision of such a method and apparatus of relatively economical initial cost, relatively economical power requirements, and relatively economical maintenance.

The method of this invention is applicable to the forming, filling and sealing of packages wherein a web of flexible packaging material travels from a supply over means for forming it into tubing around a downwardly extending mandrel, and wherein the tubing is intermittently fed downwardly on the mandrel and off the lower end of the mandrel in package length increments by a reach of each of a plurality of endless belts extending downwardly on the outside of the mandrel, this more specific method comPrising guiding each belt for travel in an endless path including said reach with a portion of said reach between the ends thereof displaceable from a retracted position wherein its face toward the mandrel is clear of the tubing to an extended Position wherein its said face engages the tubing; continuously driving each belt for continuous downward movement of its said reach; and intermittently moving said portion of said reach of each belt from its said retracted position clear of the tubing toward the mandrel to an extended position engaging the tubing and holding it in engagement therewith for a feed interval so related to the linear movement of the belt as to feed a said package length increment of the tubing downwardly on the mandrel during that interval; said portion of said reach returning to its said retracted position at the termination of said interval.

Apparatus of this invention for forming, filling and sealing packages comprises a downwardly extending mandrel, means for forming a web of flexible packaging material into tubing around the mandrel, and means for intermittently feeding the tubing downwardly on the mandrel and off the lower end of the mandrel in package length increments, said tubing feeding means comprising a plurality of endless belts on the outside of the mandrel, each having a downwardly extending tubing feeding reach facing the mandrel; means guiding each belt for travel in an endless path including said reach with a portion of said reach between the ends thereof displaceable from a retracted position wherein its face toward the mandrel is clear of the tubing to an extended position wherein its said face engages the tubing; means continuously driving each belt for continuous downward movement of its said reach; and means for intermittently moving said portion of said reach of each belt from its said retracted position clear of the tubing toward the mandrel to its said extended position engaging the tubing and holding it in engagement therewith for a feed interval so related to the linear movement of the belt as to feed a said package length increment of the tubing downwardly on the mandrel during that interval; said portion of said reach returning to its said retracted position at the termination of said interval.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
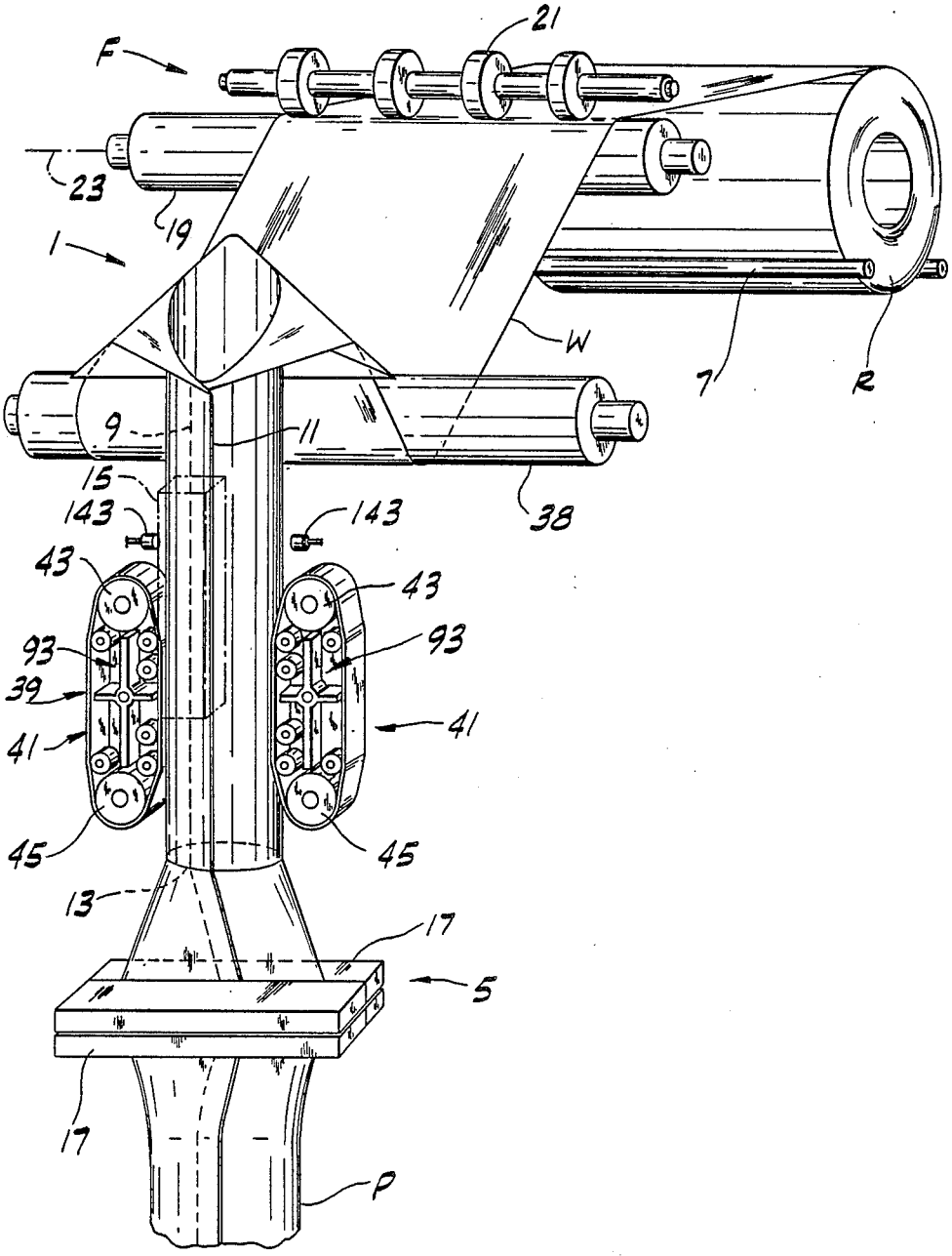
FIG. 1 is a perspective of a vertical form-fill-seal machine in which the continuous motion belt system of the present invention is embodied.

Referring first more particularly to FIG. 1 of the drawings, there is generally indicated at 1 a vertical form-fill-seal apparatus in which a web W of flexible packaging material is pulled from a supply, fed over means 3 for forming the web into tubing T, product to be packaged is provided (in any of various suitable well-known ways) in the tubing, and sealing operations are performed on the tubing as generally indicated at 5 (again in any of various suitable well-known ways) to seal it to form packages. The packaging material maY be low density polyethylene film, for example, and the supply may be constituted by a roll R of the film suitably supported as indicated at 7. The forming means or forming shoulder 3 forms the web W of packaging material into the tubing T with the longitudinal margins 9 and 11 of the web W in lapping relationship, and directs the tubing downwardly around a vertically extending, hollow mandrel 13. As illustrated, margin 9 is on the inside, margin 11 on the outside. At 15 in FIG. 1 is diagrammatically indicated suitable means for sealing the lapping margins 9 and 11 of the web to form a longitudinal seam for the tubing. Product is provided in the tubing T via the hollow mandrel 13 in suitable conventional manner, and the tubing is transversely sealed at package length intervals by the sealing means indicated at 5 below the lower end of the mandrel. The sealing means 5 may, for example, comprise a pair of sealing bars each designated 17 operable in a fixed horizontal plane below the lower end of the mandrel to form a top seal for the package being completed and the bottom seal for the next package to be formed. The seal bars may have cutting means incorporated therein (as is conventional) for cutting transversely between the seals made at 5 to separate the completed package P from the tubing. The tubing is intermittently fed downwardly one package length increment, the seal bars 17 being open. The tubing dwells between successive feed cycles, the seal bars being closed on the tubing for the transverse sealing operation during each dwell. Suitable means, which may be wholly conventional and well known in the art, is used for moving the seal bars toward and away from one another.

The web W is intermittentlY pulled from supply roll R, measured for each sealing operation at 5, and fed forward toward the forming shoulder 3 by means indicated generally at F located between the supply roll and the forming shoulder. This means F is intermittently operable to apply a forward force to the web at a position between the supply roll and the forming shoulder for feeding the web forward one package length increment in a given interval. Thus, it acts as a web feeding and measuring or metering means. As illustrated, it comprises a lower roll 19 and an upper roll 21 with means indicated generally at 23 for intermittently driving these rolls through a predetermined interval corresponding to the desired length for the packages to be formed to feed the web forward one such increment.

The web W travels from the measuring and feeding rolls 19 and 21 under a guide roll 38 and thence up to and around forming shoulder 3. The increment of the web W fed forward by the measuring and feeding rolls 19 and 21 is taken up and pulled over the forming shoulder 3 under tension by tubing feeding means indicated generally at 39 in FIG. 1 below the forming shoulder comprising a pair of endless belts each designated 41 at opposite sides of the mandrel 13.

As thus far described, the vertical form-fill-seal apparatus 1 is basically the same as that shown and described in the aforesaid James U.S. Pat. No. 4,288,965, which is incorporated herein by reference. The drive means 23 for the rolls 19 and 21 may be the same as the drive means 23 described in said James patent and its details need not be repeated here. The apparatus of this invention differs from the prior apparatus of said James patent in that where the belts 41 of the prior apparatus are intermittently driven for intermittently feeding the tubing T downwardly in package length increments, the belts 41 of the present invention are continuously driven for continuous movement of their downwardly travelling inner reaches, intermittent downward feed of the tubing in package length increments being effected by intermittently moving a portion of the downwardly travelling inner reach of each belt to an extended position engaging the tubing and holding it in engagement therewith for a feed interval so related to the linear movement of the belt as to feed a package length increment of the tubing downwardly on the mandrel during that interval, said reach returning to a retraced position clear of the tubing at the termination of said interval.

Each of the endless belts 41 is guided for travel in an endless path including an inner reach **41*a* facing the mandrel 13, i.e., facing the tubing T on the mandrel, and an outer return reach 41*b* away from the mandrel. The inner reach 41*a* travels downwardly in the direction of feed of the tubing T on the mandrel. The outer return reach travels upwardly. Means for guiding each belt for travel in its said endless path comprises an upper pulley 43 and a lower pulley 45 mounted on a support 47 suitably affixed at the respective side of the mandrel to framework (not shown) of the machine. This support is generally of box-like form having a generally rectangular vertical wall 49 which may be referred to as its back wall with an offset as indicated at 51 and top, bottom and side walls 53, 55 and 57, respectively, being open at its face as indicated at 59 opposite the back wall 49. On the outside of the back wall of the support 47 is a bracket structure 61 for mounting the support 47 on the machine framework. The lower pulley 45 is the drive pulley for the belt, being suitably secured on a drive shaft 63 journalled for rotation on a horizontal axis perpendicular to the back wall 49 in a bearing 65 at the lower end of the support or box 47, this bearing being formed integrally with the bottom wall 55. The shaft 61 extends forward out of the bearing 65 at the front of the support 47, the pulley 45 being located in a vertical plane outside the open face 59 of the support, this plane extending radially with respect to the mandrel on the respective side of the mandrel. The shaft 63 is driven continuously at a predetermined selected speed for continuously driving the belt at the requisite speed of feed for the tubing T by a motorized drive such as diagrammed at 67 in FIG. 6. The drive may include a universal-jointed drive train enabling adjustment of the support 47 to different positions for different mandrel sizes. The upper pulley 43 is an idler and belt-tensioning pulley, being mounted on a shaft 69 on an axis parallel to and directly above (in the vertical plane of) the drive shaft 63 extending from a cylindric slide member 71 which is vertically slidable in a vertical bore 73 in a guide block 75 fastened by screws such as indicated at 77 in FIG. 7 to upper and lower webs such as indicated at 79 and 81 in the box-like support 47 on its back wall 49 and seated on an extension 83 of the lower web 81. The shaft 69 for the upper pulley 43 is secured at its inner end in a hole 85 in the cylindric slide 71 and extends forward out of the box 47, having a square enlarged section 87 slidable in a vertical slot 89 in the guide block 75. A coil compression spring 91 accommodated in the bore 73 reacts from the extension 83 of web 81 upwardly against the lower end of the cylindric slide 71 to bias the slide, the shaft 69 and the pulley 43 upwardly for tensioning the belt 41**.

Figure 2:
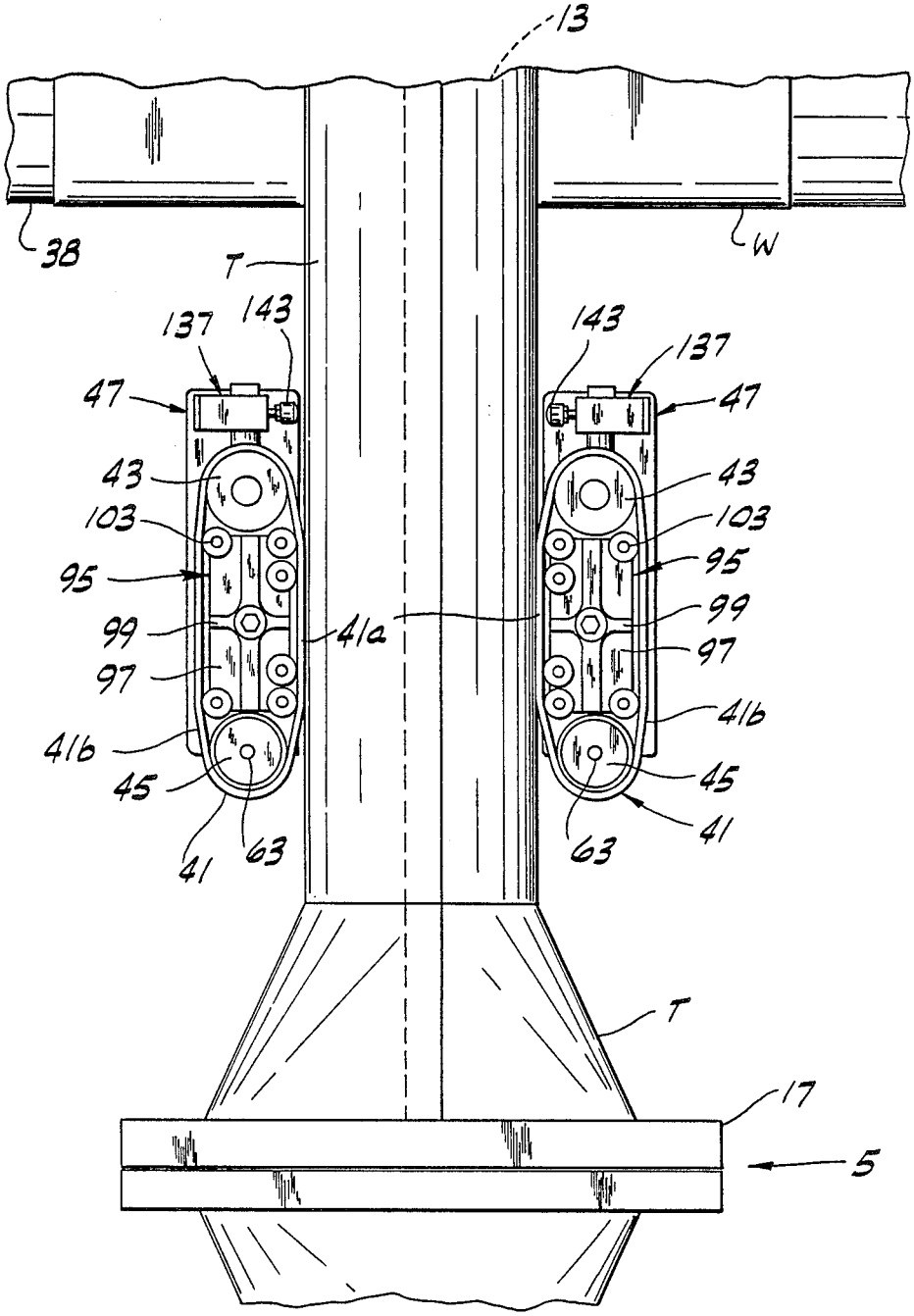
FIG. 2 is a front elevation of a fragment of FIG. 1 on a larger scale than FIG. 1, showing the belts on opposite sides of the mandrel of the machine with the tubing feeding reaches of the belts in their extended tubing feeding position engaging the tubing on the mandrel for feeding it downwardly on the mandrel, and the return reaches of the belts, in their retracted position.
Figure 3:
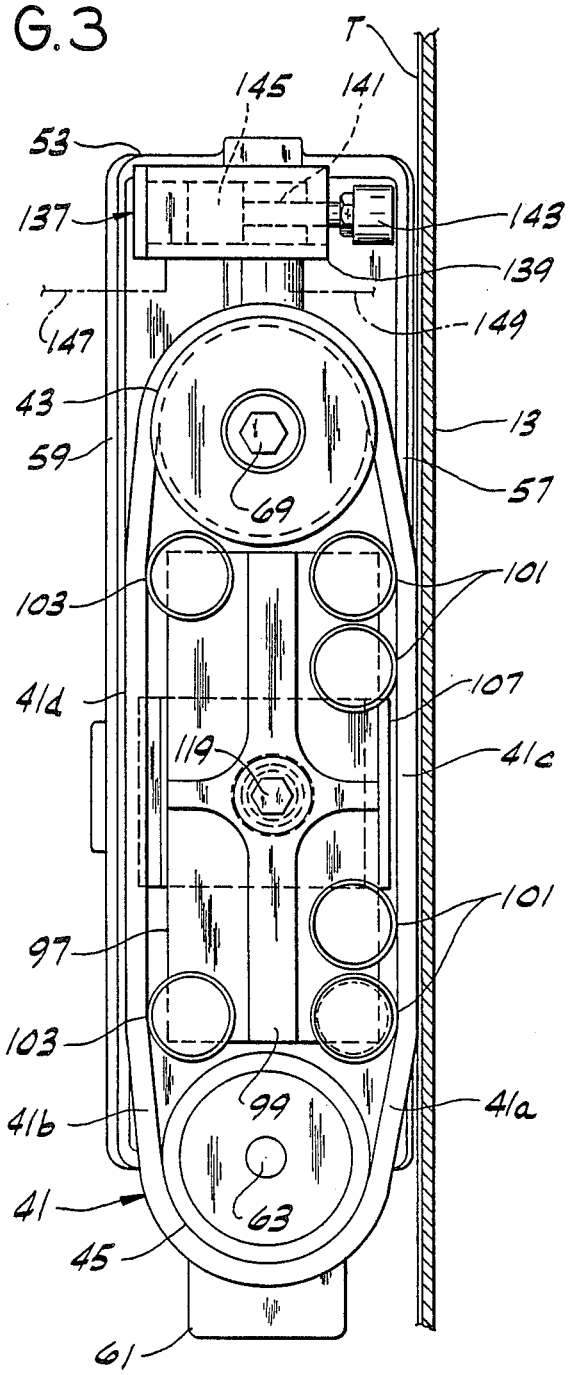
FIG. 3 is a front elevation of one of the belts on a larger scale than FIG. 2 and showing further detail.
Figure 4:
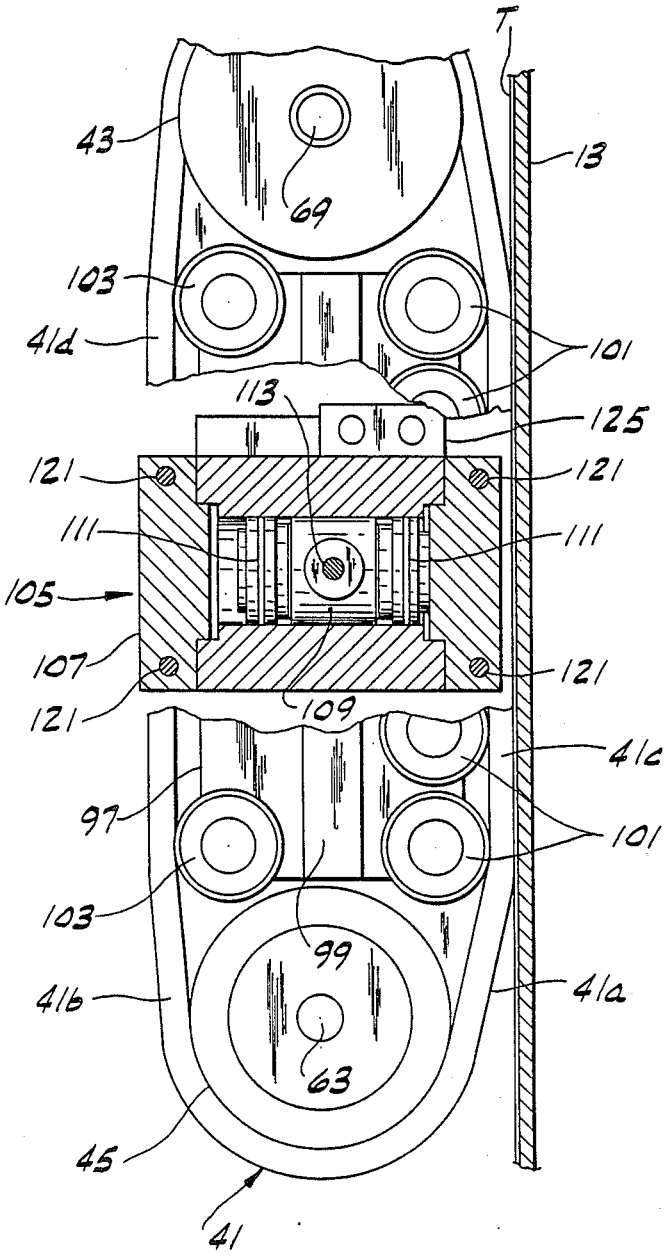
FIG. 4 is a view similar to FIG. 3 but with parts broken away and an air cylinder of the system shown in section.
Figure 5:
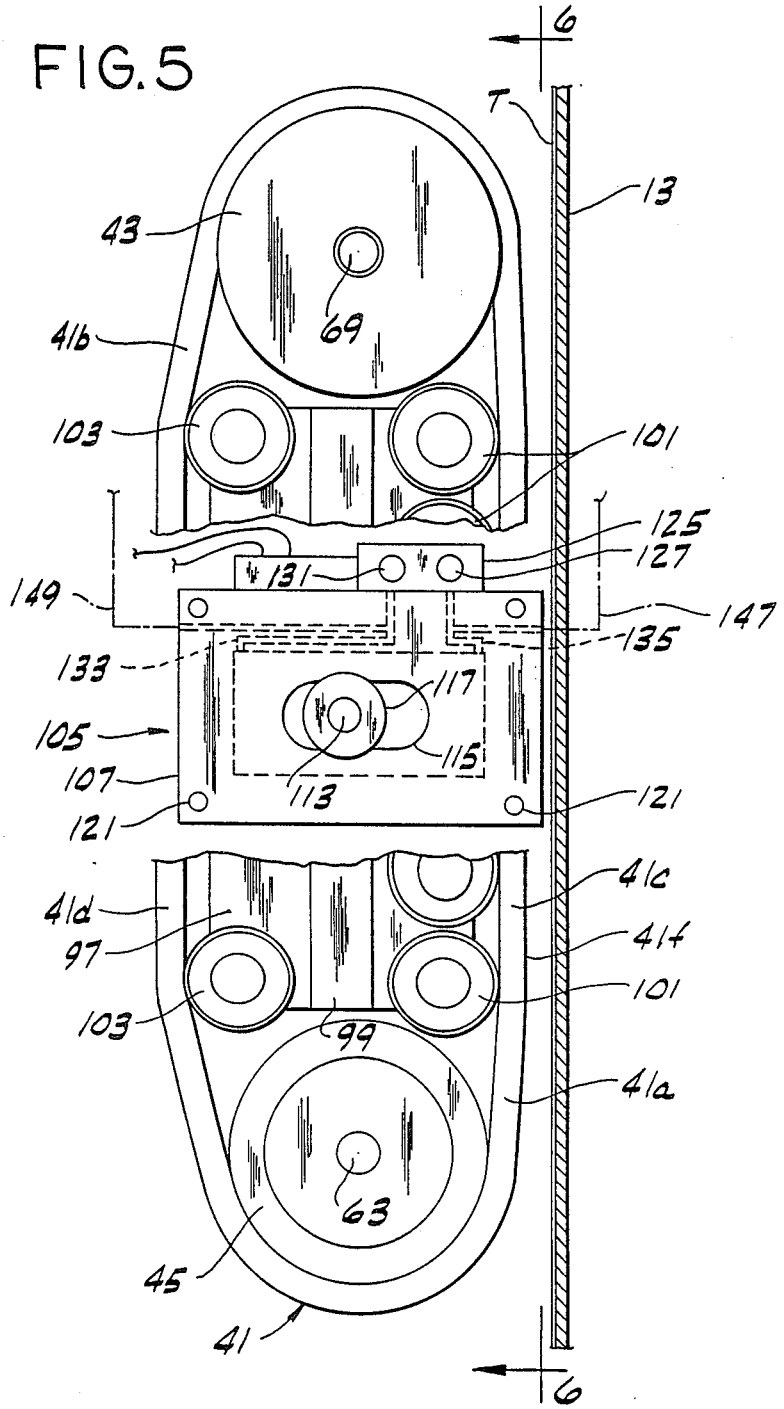
FIG. 5 is a view similar to FIG. 4 but with the air cylinder shown in elevation, and showing the tubing feeding reach of the belt in its retracted position and the return reach of the belt in its extended position, certain air passaging being shown diagrammatically.

A portion **41*c* of the inner reach 41*a* of each belt between the upper and lower ends of this reach is displaceable from the retracted position in which it is shown in FIG. 5, wherein its face 41*f* toward the mandrel 13 (toward the tubing T) is spaced from the tubing T a relatively short distance, e.g., ¼ inch, sufficient to insure its being clear of the tubing, to the extended position in which it is shown in FIGS. 2–4 wherein its face 41*f* engages the tubing T (backed by the mandrel 13). A portion 41*d* of the outer return reach 41*b* between its lower and upper ends is concomitantly displaceable from the outwardly extended position in which it appears in FIG. 5 to the retracted (inner) Position in which it is shown in FIGS. 2–4. Thus, when the stated portion 41*c* of the inner reach is out, the portion 41*d*** of the outer reach is in, and vice versa. The belt length remains constant.

Movement of the portion **41*c* of the inner reach 41*a* of each belt 41 from its retracted to its extended position is effected by means indicated in its entirety at 93 and comprising a shifter generally designated 95 located between the inner and outer reaches 41*a* and 41*b* of the belt 41 and between the upper and lower pulleys 43 and 45, and thus located on the inside of the endless path of the belt. This shifter 95 comprises a plate 97 having a cruciform stiffening rib formation such as indicated at 99 on one face constituting its outside face and carrying a set of four rollers each designated 101 on its said outside face which are arranged in vertical alignment adjacent the vertical edge of the plate toward the inner reach 41*a* of the belt 41, these rollers being engageable with the inside of the inner reach (more particularly with the inside of portion 41*c* of the inner reach), and a set of two rollers each designated 103 on its said outside face arranged in vertical alignment adjacent the other vertical edge of the plate engageable with the inside of the outer return reach 41*b* of the belt (more particularly with the inside of the portion 41*d* of the return reach). The shifter 95, carrying the four rollers 101 engaging the inside of the inner reach 41*a* of the belt and the two rollers 103 engaging the inside of the outer return reach 41*b* of the belt, is horizontally movable between a first or inner position, in which it appears in FIGS. 2–4, wherein it holds portion 41*c* of the inner reach in its extended position engaging the tubing T, backed up by the mandrel 13, the outer reach 41*b* then being in its retracted position, and a second or outer position, in which it appears in FIG. 5, wherein portion 41*c* is in its retracted position clear of the tubing and portion 41*d* of the outer return reach 41*b* is in extended position. Movement of the shifter is effected by means indicated generally at 105 comprising an air cylinder 107 mounted in the box 47 with its axis extending horizontallY from one side of the box to the other, this air cylinder having an elongate piston 109 therein with annular seals 111 adjacent the ends of the piston, and with a pin 113 extending laterally from the piston at the center of length of the piston through an elongate horizontal slot 115 in the outside of the cylinder (the side at the open face of the box 47). The outer end of the pin is received in a bushing 117 in a hole in the shifter plate 97 at the center of the cruciform rib formation 99 on the plate 97, the pin and plate being fastened together as by a screw 119. The cylinder is fastened as by screws at 121 to posts 123 in the box 47 on the back of the box. Mounted on top of the cYlinder 107, and thus in close proximity thereto, is an electrically operated air valve 125 for controlling the supply of air under pressure from a suitable source (not shown) to and exhaust of air from opposite ends of the cylinder 107 for driving the piston 109 to shift the shifter 95 back and forth between its stated first and second positions. The valve 125 is shown in FIG. 5 as having an inlet port 127 supplied with air from the source and an exhaust port 131 for exhausting air to the atmosphere. Passaging for the supplY of air to and exhaust of air from opposite ends of the cylinder under control of the valve is diagrammatically indicated in FIG. 5 at 133 for the outer end and 135** for the inner end of the cylinder.

Figure 6:
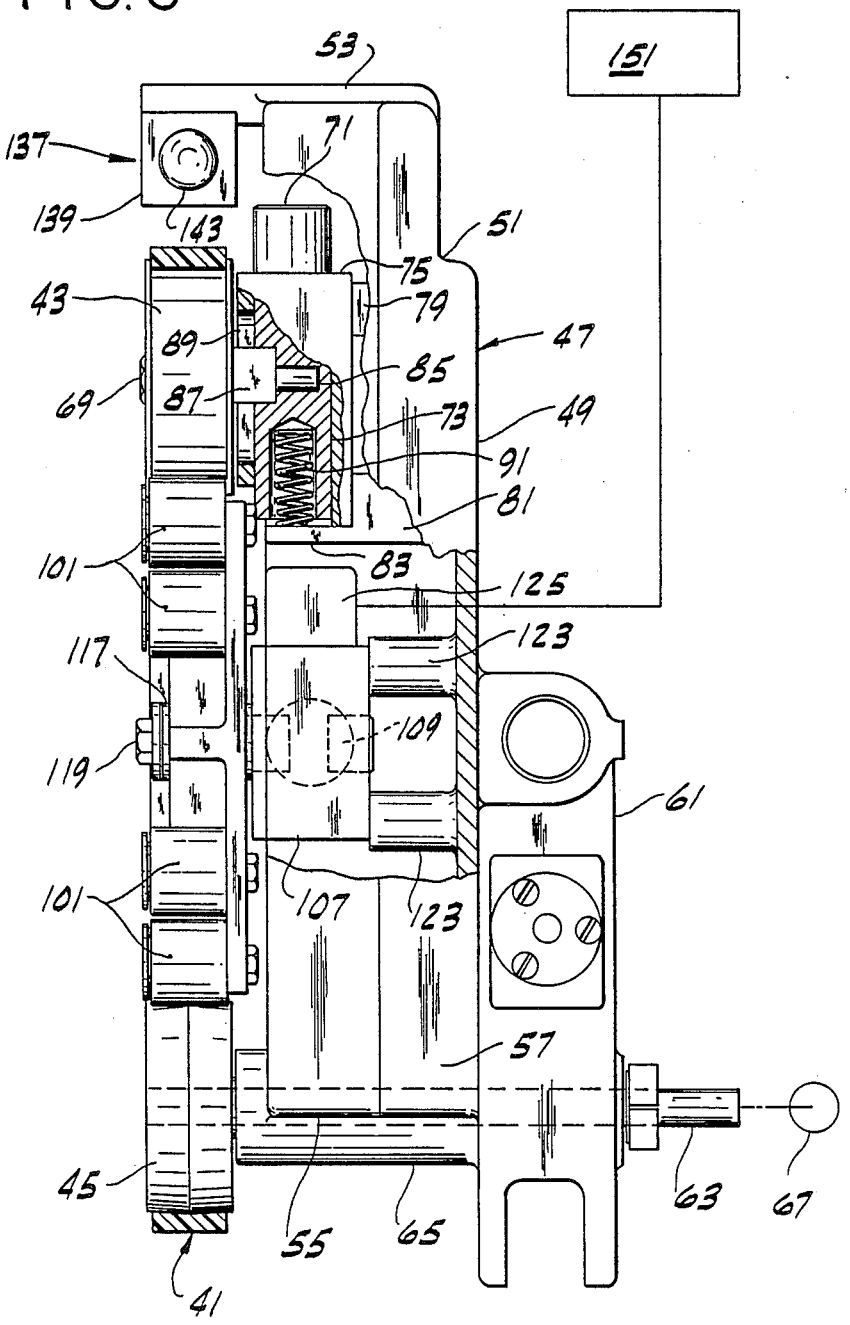
FIG. 6 is a view generally on line 6—6 of FIG. 5 with parts broken away and shown in section.
Figure 7:
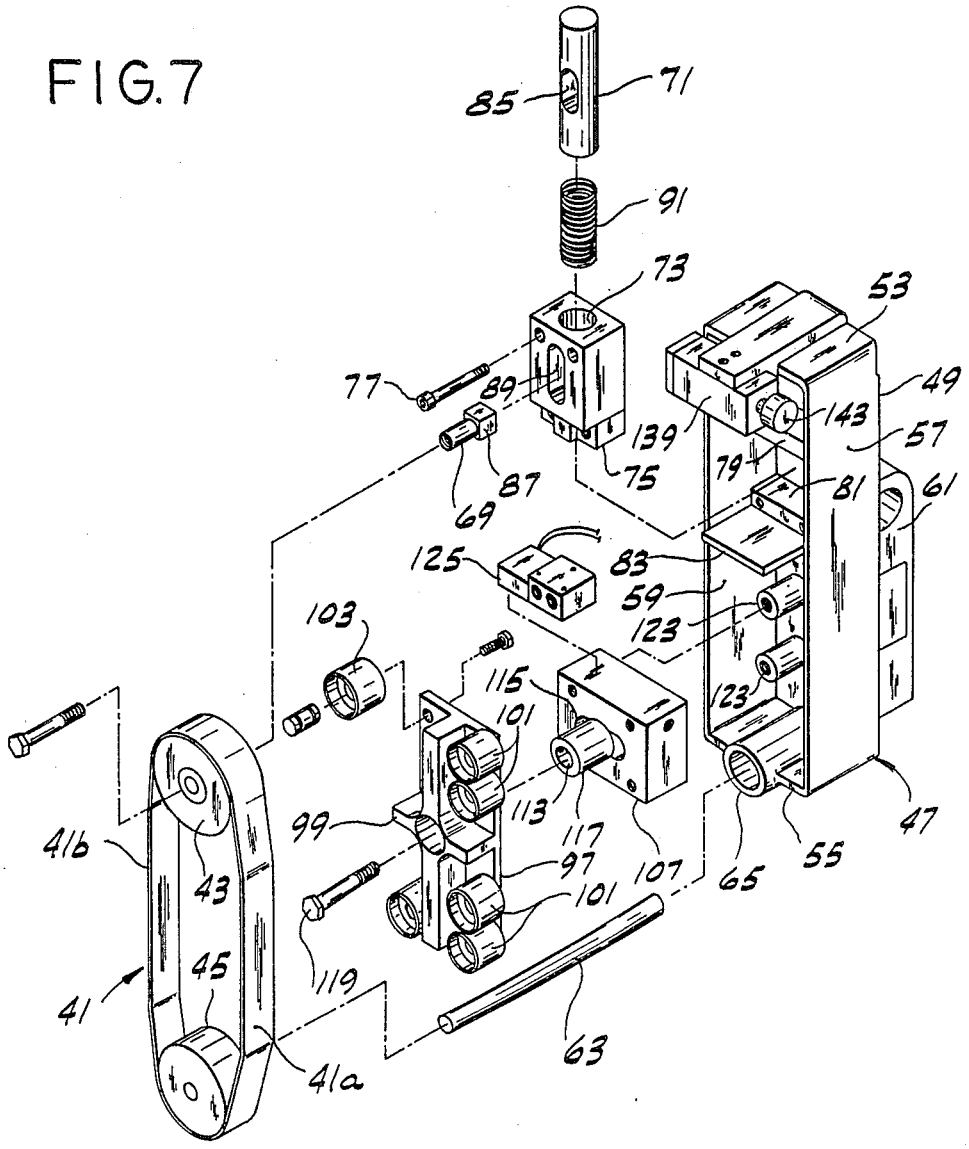
FIG. 7 is an exploded perspective of one of the belt assemblies.

At 137 in FIGS. 3 and 6 is generally indicated means for holding the tubing T against movement along the mandrel 13 during each dwell interval between feed intervals. This means, as illustrated, comprises two air cylinder 139 each mounted on an extension of the top of a respective box 47 having a piston rod 141 carrying a pressure pad or brake shoe 143 for engaging the tubing T when the piston rod is extended to clamp the tubing against movement along the mandrel. Each cylinder 139 is arranged in a radial plane of the mandrel 13 at the top of the respective box with its piston rod 141 extending out of its inner end (its end toward the mandrel) from a piston 145 therein. Operation of each air cylinder 139 is under control of the respective valve 125, the outer end of the cylinder 139 being interconnected by a line 147 with passaging 135 and the inner end of the cylinder being interconnected by a line 149 with passaging 133 so that the operation of each air cylinder 139 is the opposite of that of the respective air cylinder 107. Thus, each brake shoe 143 is retracted when the portion 41*c* of the inner reach 41*a* of the respective belt 41 is extended for feeding the tubing T downwardly, and is applied to the tubing to brake it when the portion 41*c* of the inner reach 41*a* is retracted.

As diagrammed in FIG. 6, each of the valves 125 may be under control of a programmable controller 151 corresponding generally to the programmable controller shown at 35 in the aforesaid James U.S. Pat. No. 4,288,965, the controller acting intermittently to actuate each of the valves 125 for operation of the elongate pistons 109 of the air cylinders 107 to move the shifters 95 from their stated second position (FIG. 5) wherein portion 41*c* of the inner reach 41*a* of each belt 41 is in its retracted position clear of the tubing T to its stated first position (FIGS. 2–4) for extending (bulging out) portion 41*c* of each belt to engage the tubing T, backed up by the mandrel 13. At the same time, each brake cylinder 139 is actuated to retract the respective brake shoe 143 to release the tubing. The belts 41 being in continuous motion, their inner reaches 41*a*, in engagement with the tubing and moving downward, drive the tubing down on the mandrel 13. The shifters are maintained in their stated first position for driving the belts downward for a predetermined interval of time, as determined by the programmable controller, such as to effect downfeed of the requisite package length of the tubing and then the valves 125 are deactuated for return operation of the pistons 109 to return the shifters 95 to the stated second position wherein the inner reaches 41*a* of the belts 41 are clear of the tubing. At the same time, the brake cylinders 139 are actuated to apply the brake shoes to the tubing to brake the tubing against movement during the ensuing dwell of the tubing in which the sealing and severing of the tubing takes place. It will be observed that when each shifter 95 is in its outer position, the outer return reach 41*b* of the resPective belt is in extended position and the inner reach 41*a* is in retracted position (FIG. 5). When each shifter 95 moves to its inner position, the outer return reach 41*b* of the respective belt is in retracted position and the portion 41*c* of its inner reach is in extended (bulged-out) position (FIGS. 2–4). The extension of the portion 41*c* of the inner reach 41*a* of each belt is effected without any over stretching of the belt, the belt length remaining substantiallY constant, the belt being maintained under tension by the upward bias of spring 91 on the upper pulley 43.

With the continuous motion belt system of this invention as described and hereinafter claimed, inertia inherent in any system which starts and stops the tubing drive belts is completely eliminated. The elimination of the start-stop inertia permits the design of the belt system to be such that belt pulley diameters may be increased, belt length may be increased and belt thickness may be increased, all factors increasing the belt life. In addition, the increase of pulleY diameter increases the frictional contact of the belt with the pulley to minimize the possibility of slippage between the pulleys and the belts.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of forming, filling and sealing packages wherein a web of flexible packaging material travels from a supply over means for forming it into tubing around a downwardly extending mandrel, and wherein the tubing is intermittently fed downwardly on the mandrel and off the lower end of the mandrel in package length increments by a reach of each of a plurality of endless belts extending downwardly on the outside of the mandrel, the method comprising:

guiding each belt for travel around upper and lower guide means in an endless path including said reach with said reach extending down from the upper to the lower guide means, with the upper and lower ends of said reach spaced from the outside of the mandrel a distance somewhat greater than the thickness of said material and thereby being somewhat spaced from the outside of the tubing on the mandrel, the guide means being held generally against horizontal displacement relative to the mandrel so that the spacing of the upper and lower ends of said reach from the outside of the tubing is maintained;

an intermediate portion of said reach between its said upper and lower ends being displaceable generally without horizontally displacing said guide means from a retracted position wherein its face toward the mandrel is clear of the tubing to an extended position wherein its said face engages the tubing;

continuously driving each belt for continuous downward movement of its said reach; and generally without horizontally displacing said upper and lower guide means, intermittently moving said intermediate portion of said reach of each belt from its said retracted position clear of the tubing toward the mandrel to an extended position engaging the tubing and holding it in engagement therewith for a fed interval so related to the linear movement of the belt as to feed a said package length increment of the tubing downwardly on the mandrel during that interval;

said intermediate portion of said reach returning to its said retracted position at the termination of said interval.

2. The method of claim 1 wherein the length of each belt is maintained relatively constant as said portion of its said reach is moved out to said extended position and as it returns to its retracted position.

3. The method of claim 2 wherein said portion of said reach of each belt is moved out to extended position from the inside of its said endless path.

4. The method of forming, filling and sealing packages wherein a web of flexible packaging material travels from a supply over means for forming it into tubing around a downwardly extending mandrel, and wherein the tubing is intermittently fed downwardly on the mandrel and off the lower end of the mandrel in package length increments by a reach of each of a plurality of endless belts extending downwardly on the outside of the mandrel, the method comprising:

guiding each belt for travel in an endless path including said reach with a portion of said reach between the ends thereof displaceable from a retracted position wherein its face toward the mandrel is clear of the tubing to an extended position wherein its said face engages the tubing;

continuously driving each belt for continuous downward movement of its said reach;

intermittently moving said portion of said reach of each belt from its said retracted portion clear of the tubing toward the mandrel to an extended position engaging the tubing and holding it in engagement therewith for a feed interval so related to the linear movement of the belt as to feed a said package length increment of the tubing downwardly on the mandrel during that interval;

said portion of said reach returning to its said retracted position at the termination of said interval;

the length of each belt being maintained relatively constant as said portion of its said reach is moved out to said extended position and as it returns to its retracted position;

said portion of said reach of each belt being moved out to extended position from the inside of its said endless path; and wherein the endless path in which each belt is guided includes a return reach of the belt opposite the first-mentioned reach, said return reach being in an extended position when said portion of the first-mentioned reach is in retracted position and assuming a retracted position when said portion of the first-mentioned reach moves to extended position.

5. The method of claim 4 wherein the tubing is held against movement along the mandrel during dwell intervals between said feed intervals.

6. Apparatus for forming, filling and sealing packages having a downwardly extending mandrel, means for forming a web of flexible packaging material into tubing around the mandrel, and means for intermittently feeding the tubing downwardly on the mandrel and off the lower end of the mandrel in package length increments, said tubing feeding means comprising:

a plurality of endless belts on the outside of the mandrel, each having a downwardly extending tubing feeding reach facing the mandrel;

upper and lower pulleys guiding each belt for travel in an endless path including said reach with said reach extending down from the upper to the lower pulley, with the upper and lower ends of said reach at the upper and lower pulleys spaced from the outside of the mandrel a distance somewhat greater than the thickness of said material and thereby being somewhat spaced from the outside of the tubing on the mandrel, the pulleys being held generally against horizontal displacement relative to the mandrel so that the spacing of the upper and lower ends of said reach from the outside of the tubing is maintained;

an intermediate portion of said reach between its said upper and lower ends being displaceable generally without horizontally displacing said upper and lower pulleys from a retracted position wherein its face toward the mandrel is clear of the tubing to an extended position wherein its said face engages the tubing;

means continuously driving each belt for continuous downward movement of its said reach; and means operable generally without horizontally displacing said upper and lower pulleys for intermittently moving said intermediate portion of said reach of each belt from its said retracted position clear of the tubing toward the mandrel to its said extended position engaging the tubing and holding it in engagement therewith for a feed interval so related to the linear movement of the belt as to feed a said package length increment of the tubing downwardly on the mandrel during that interval;

said intermediate portion of said reach returning to its said retracted position at the termination of said interval.

7. Apparatus as set forth in claim 6 having means associated with each belt for maintaining the belt length relatively constant as said intermediate portion of said reach is moved out to said extended position and as it returns to its retracted position.

8. Apparatus as set forth in claim 7 wherein the means for intermittently moving said intermediate portion of said reach of each belt is on the inside of the endless path of the belt.

9. Apparatus as set forth in claim 8 wherein the means for intermittently moving said reach of each belt comprises a shifter engageable with the inside of said intermediate portion of said reach and movable between a first position wherein said intermediate portion is in its said retracted position and a second position for moving said intermediate portion outwardly to its said extended position, and means for moving said shifter between its said first and second positions.

10. Apparatus as set forth in claim 9 wherein the means for moving each shifter comprises an air cylinder and a valve controlling the cylinder in close proximity thereto.

11. Apparatus for forming, filling and sealing packages having a downwardly extending mandrel, means for forming a web of flexible packaging material into tubing around the mandrel, and mean for intermittently feeding the tubing downwardly on the mandrel and off the lower end of the mandrel in package length increments, said tubing feeding means comprising:

a plurality of endless belts on the outside of the mandrel, each having a downwardly extending tubing feeding reach facing the mandrel;

means guiding each belt for travel in an endless path including said reach with a portion of said reach between the ends thereof displaceable from a retracted position wherein its face toward the mandrel is clear of the tubing to an extended position wherein its said face engages the tubing;

means continuously driving each belt for continuous downward movement of its said reach;

means for intermittently moving said portion of said reach of each belt from its said retracted position clear of the tubing toward the mandrel to its said extended position engaging the tubing and holding it in engagement therewith for a feed interval so related to the linear movement of the belt as to feed a said package length increment of the tubing downwardly on the mandrel during that interval;

said portion of said reach returning to its said retracted position at the termination of said interval;

means associated with each belt for maintaining the belt length relatively constant as said portion of said reach is moved out to said extended position and as it returns to its retracted position;

the means for intermittently moving said portion of said reach of each belt being on the inside of the endless path of the belt; and the means guiding each belt comprising means for guiding it with a return reach opposite the first-mentioned reach and means for holding said return reach in an extended position when said portion of the first-mentioned reach is in retracted position and in a retracted position when said portion of the first-mentioned reach is in extended position.

12. Apparatus as set forth in claim 11 wherein the means for intermittently moving said intermediate portion of said first-mentioned reach of each belt comprises a shifter engageable with the inside of said intermediate portion of said reach and movable between a first position wherein said intermediate portion is in its said retracted position and a second position for moving said intermediate portion outwardly to its said extended position, and means for moving said shifter between its said first and second positions, and the means for holding said return reach of each belt in an extended position comprises means on the respective shifter engaging the inside of a portion of said return reach opposite said intermediate portion of the first-mentioned reach.

13. Apparatus as set forth in claim 12 wherein the means for continuously driving the belt operates continuously to drive one of the pulleys, the other pulley being movable toward and away from the driven pulley and biased vertically in the direction away from the driven pulley.

14. Apparatus as set forth in claim 11 having means for holding the tubing against movement along the mandrel during dwell intervals between said feed intervals.

* * * * *